US005532096A

United States Patent [19]

Maruta et al.

[11] Patent Number: 5,532,096

[45] Date of Patent: Jul. 2, 1996

[54] ELECTROPHOTOGRAPHIC CARRIER AND PRODUCTION PROCESS THEREFOR

[75] Inventors: Masayuki Maruta, Osaka; Jun Shimizu, Wakayama, all of Japan

[73] Assignee: Kao Corporation, Tokyo, Japan

[21] Appl. No.: 361,525

[22] Filed: Dec. 22, 1994

[30] Foreign Application Priority Data

Dec. 24, 1993 [JP] Japan ..... 5-326392

[51] Int. Cl.[6] ..... G03G 9/113

[52] U.S. Cl. ..... 430/108

[58] Field of Search ..... 430/108, 115, 430/120

[56] References Cited

U.S. PATENT DOCUMENTS 3,849,127 11/1974 Madrid et al. ..... 252/62.1
5,254,425 10/1993 Suzuki et al. ..... 430/115
5,407,887 4/1995 Miyashita et al. ..... 502/258

FOREIGN PATENT DOCUMENTS 55-127569 10/1980 Japan .
5632149 4/1981 Japan .
56-140358 11/1981 Japan .
60-115946 6/1985 Japan .

*Primary Examiner*—John Goodrow
*Attorney, Agent, or Firm*—Birch, Stewart, Kolasch & Birch

[57] ABSTRACT

The present invention relates to an eletrophotographic carrier characterized by that the surface thereof is coated and cured with a partially hydrolyzed sol obtained from at least one alkoxide selected from the group consisting of silicon alkoxides, titanium alkoxides, aluminum alkoxides and zirconium alkoxides, and the production process therefor. Use of the carrier of the present invention mixed with a toner to prepare a developer can always supply a stable image without a coated layer being peeled off during use.

7 Claims, No Drawings

ELECTROPHOTOGRAPHIC CARRIER AND PRODUCTION PROCESS THEREFOR

FIELD OF THE INVENTION

The present invention relates to an electrophotographic carrier to provide suitable charges to a powder toner and thereafter develop and visualize electrostatic latent images formed on a photoconductor and transporting the toner to a developing unit in electrophotography and electrostatic recording, and the production process therefor.

PRIOR ARTS

Eletrophotographic recording technology comprises steps of uniformly electrostatically charging a photoconductor layer, then exposing the layer to light to form electrostatic latent images by allowing the charges to disappear from the exposed parts and further attaching colored fine toner powder having an electrostatic charge on the above electrostatic latent images to visualize them (developing process), transferring the thus developed toner images onto a transfer material such as paper (transferring process) and then permanently fixing them by heating, pressing or conducting another fixing method (fixing process). Further a cleaning process is effected to remove toner remaining on the photoconductor after having transferred the toner.

In such an electrophotographic recording system, the developing process to developing electrostatic latent images for visualization includes a liquid developing process and a dry developing process. In recent years, the dry developing process has become more popular from the viewpoint of possible simplification of equipments and safety. The dry developing process includes a magnetic single component developing process in which toner is transported to the developing unit by virtue of the magnetic force of a magnetic substance contained in the toner without assistance by carrier, a non-magnetic single component developing process in which toner is transported to the developing unit by virtue of charges possessed by the toner without any magnetic substance, and a dual component magnetic brushing developing process in which magnetic carrier is mixed with toner to transport the toner to the developing unit by virtue the magnetic force of the carrier.

The magnetic single component and non-magnetic component developing is often used for a copying machine and printer of a relatively low speed because the developing unit is easily designed in a small size. The dual component magnetic brushing developing process is used for a copying machine and printer of a relatively high speed because the developing step can be effected at a high speed.

Carriers to use for the magnetic brushing developing process includes an ore-reduced iron powder produced by reducing an iron ore, a mill scale-reduced iron powder produced by reducing a mill scale, a spherical atomized iron powder produced by extruding molten steel from fine openings and cooling and pulverizing it and iron nitride powder produced by nitriding flakes of steel and subjecting them to pulverization and denitrification. Further, ferrite carrier is obtained by pelletizing, drying and baking ferrite powder containing $Fe_2O_3$ as the primary raw material. Since iron powder carrier is oxidized by water contained in air to generate $Fe_2O_3$, a so-called rust on the surface thereof, it is covered with a stable thin film of the oxide having a relatively high resistivity by effecting oxidation. This way electrical resistance of the carrier can be controlled by how far to effect the oxidation.

Ferrite carrier, on the other hand, has such characteristics that its true specific gravity is smaller by 30 to 40% than iron powder carrier, its electrical resistance and magnetic characteristics can be changed according to need to a large extent, it can be spherically formed and thereby has good fluidity, and the carrier can have a small amount of remanent magnetism. These are reasons for a long life of the ferrite carrier, which does not, however, reach a completely satisfactory level. Further a resin-coated carrier is obtained by providing a resin-coated layer on core particles of iron powder carrier or ferrite carrier. The resin-coated layer is practically required to have sufficient abrasion resistance and heat resistance, a strong adhesion property to core particles, a proper surface tension to prevent toner from attaching onto the surface of carrier particles and a suitable charging property to toner.

That is, the resin-coated carriers are brought into contact with toiler particles, other carrier particles and parts of the developing machine such as a regulating blade in a developing unit. These facts allow the coated layer to be abraded by friction and to give unstable charges to the toner. Further, in the case where adhesion between the coated layer and the core particle is insufficient, the coated layer is peeled off by friction and collision of the carrier particles with themselves, and a stable, triboelectric charge can not be provided. Further, attachment of toner on a resin-coated layer surface of carrier changes the triboelectric charging property to a large extent.

Various resins are tested as a resin to coat carrier core particles. For example, an acrylic resin and a styrene-acrylic resin is used in view of adhesion property to core particles. Those resins are liable to be sticked by toner because of its large surface energy and thereby it is difficult to obtain a developer having a long life. To the contrary, a fluorine resin having a small surface energy is tested in view of its surface energy. The fluorine resin, however, inherently has a weak adhesive force to the core particles and is liable to peel off during use. Further, because it is difficult to dissolve it in a solvent, operations of thermal treatment of the coated carrier gets more complicated and therefore the product gets more expensive. In addition, adhesion between the core particles and the coated film is weak.

Besides, a silicone resin is taken as a resin having a small surface energy. The silicone resin has such advantages that it has low surface tension and high electrical resistance. However, it still has a weak adhesion property to core particles, resulting in a defect such that it is liable to peel off in use. For the purpose of overcoming the defects of the silicone resin, JP-A 55-127569 shows modification of the silicone resin by use of another resin. JP-A 56-32149 shows incorporation of vinylsilane to to react the silicone resin with another resin. U.S. Pat. No. 3,840,464 shows a mixture of a trialkoxysilane and ethyl cellulose. U.S. Pat. No. 3,849,127 discloses a mixture of an organosilicone terpolymer and a polyphenylene resin, which is involved in problems such that film thereof is formed at a high temperature of 300° C. or more and the coated film is not even and uniform because of its poor compatibility between the mixed resins and poorer results in characteristics than expected.

Further, JP-A 55-127569 and JP-A 56-140358 show a coated layer at a relatively low curing temperature, which includes problems such that it has insufficient adhesion and lacks in durability.

Then JP-A 60-115946 shows coating a carrier with a metal alkolate such as aluminum burylate together with a conventional epoxy resin for the purpose of improving the charging property of the carrier. Usually, however, this compound does not react well with the resin and for this reason durability of the coated film of carrier core particles is liable to be damaged.

Organic silicone resins have a weak adhesion force and causes the film to peel off.

SUMMARY OF THE INVENTION

The present inventors, in order to solve the problems on the durability of a carrier as described above, have made the electrophotographic carrier of the present invention which has a sufficient durability and excels in charge-providing ability and have succeeded in providing a developer employing the carrier of the invention which can stably supply a good image and has excellent durability.

The present invention provides a coated eletrophotographic carrier particle which comprises an electrophotographic core particle having a coated layer on the surface thereof, said coated layer obtained by curing a partially hydrolyzed sol obtained from at least one alkoxide selected from the group consisting of silicon alkoxides, titanium alkoxides, aluminum alkoxides and zirconium alkoxides. This partially hydrolyzed sol is formed by way of a tri- or more valent polyfunctional alkoxide.

The invention includes the carrier particle which consists essentially of the core particle and the coated layer.

The invention provides a coated electrophotographic carrier particle which consists essentially of:

an electrophotographic core particle and a crosslinked alkoxide coated on said core particle, said alkoxide selected from the group consisting of silicon alkoxides, titanium alkoxides, aluminum alkoxides and zirconium alkoxides.

It is preferable that said alkoxide is a silicon alkoxide. It is preferable that the coated layer has an effective thickness to the above shown purposes of the invention. The amount of the sol of the invention is shown to the weight of the core particles. This may indicate a thickness of the coated layer on the average.

The coated layer can be obtained by coating and curing the coating liquid including the partially hydrolyzed sol. It is preferable that the coating of the carrier particle consists essentially of the partially hydrolyzed sol.

It is preferable that the coating liquid comprises a further alkoxide, being monofunctional or polyfunctional, containing at least one element selected from the group consisting of B, Mg, Al, Si, Ca, Ti, V, Cr, Mn, Fe, Co, Ni, Cu, Zn, Ca, Ge, St, Y, Zr, Nb, In, Sn, Sb, Ba, La, Ce, Pr, Nd, Sm, Gd, Dy, Er, Yb, and Ta.

The invention moreover provides a process for the production of a coated eletrophotographic carrier particle which comprise the steps of coating an electrophotophgraphic carrier particle with a partially hydrolyzed sol obtained from at least one alkoxide selected from the group consisting of silicon alkoxides, titanium:alkoxides, aluminum alkoxides and zirconium alkoxides; and curing said coating.

The process for the production preferably comprises a further step of adding to said partially hydrolyzed sol an alkoxide containing at least one element selected from B, Mg, Al, Si, Ca, Ti, V, Cr, Mn, Fe, Co, Ni, Cu, Zn, Ga, Ge, Sr, Y, Zr, Nb, In, Sn, Sb, Ba, La, Ce, Pt, Nd, Sm, Gd, Dy, Er, Yb and Ta.

In a method for developing an electrostatic latent image with a developer, the invention provides an improvement comprising using the coated electrophotographic carrier particles as defined above and a toner. The invention provides use of the carrier as defined above for developing an electrostatic latent image.

That is, the present invention relates to an eletrophotographic carrier characterized by that the surface thereof is coated and cured with a partially hydrolyzed sol obtained from at least one alkoxide selected from the group consisting of silicon alkoxides, titanium alkoxides, aluminum alkoxides and zirconium alkoxides, and the production process therefor. The preferred curing conditions are a temperature of 80° to 300° C., more preferably 150° to 200° C., and a period of time of 20 to 30 minutes.

In addition to the carrier coated and cured with the specific inorganic polymer described above, the present invention provides a production process for the carrier coated with an inorganic polymer by coating a carrier core with the partially hydrolyzed sol described above, curing and removing an organic functional group to convert it to an inorganic product.

Further, the present invention provides a method for developing an electrostatic latent image with the carrier and toner described above, and use of the carrier for development of an electrostatic latent image.

The coated film according to the present invention has a good adhesion to a core particle, and since it has a three-dimensional network structure and its crosslinking density is high, strength is improved as well. Accordingly, peeling of the film can be prevented. It has a sufficient durability as a developer. In the coated film, charging characteristics can be controlled by combining metal with non-metal. In particular, when it is used together with a pulverized toner, it shows excellent durability and developing property.

Preferred embodiments of the present invention include (1) a carrier which has been coated with the partially hydrolyzed sol derived from a silicon alkoxide and cured; and/or (2) a carrier which has been coated with the partially hydrolyzed sol and cured to form a three-dimensionally crosslinked structure in the essentially inorganic coated layer.

Moreover it is possible to control the charging property of the carrier, without damaging the durability of the coated film, by adding an alkoxide of at least one element selected from the group consisting of B, Mg, Al, Si, Ca, Ti, V, Cr, Mn, Fe, Co, Ni, Cu, Zn, Ga, Ge, St, Y, Zr, Nb, In, Sn, Sb, Ba, La, Ce, Pt, Nd, Sm, Gd, Dy, Er, Yb, and Ta during the coating and curing step of the partially hydrolyzed sol. This way another use is made of the alkoxide which is not hydrolyzed.

The partially hydrolyzed sol used in the present invention is prepared by hydrolyzing an OR group of the alkoxide containing a polyfunctional alkoxide wherein R is an alkyl group and the carbon number is not specifically limited, however having preferably 1 to 6 carbons. The alkoxide may be at least one selected from the group consisting of silicon alkoxides, titanium alkoxides, aluminum alkoxides and zirconium alkoxides with water of less than 1:1 in terms of a mole ratio. The unhydrolyzed OR groups remain, and the residual rate thereof is 30 to 95 mole %, preferably 40 to 92 mole %.

The partially hydrolyzed sol means a sol solution containing a high polymer staying in a condition that the molecules themselves are not completely hydrolyzed and polymerized in the solution to form a network structure but the molecules are polymerized while the OR groups partially remain. There are publicly known as the means for obtaining the partially hydrolyzed sol, a hydrolysis process at room temperature, a hydrolysis process under refluxing, and a hydrolysis process in which a catalyst is added. As for a process for readily obtaining the partially hydrolyzed sol, alcohols which are water miscible solvents, such as ethyl alcohol, isopropanol and methyl alcohol are added to an alkoxide solution, and then acid water prepared by adding hydrochloric acid and acetic acid is added in an amount less than the whole mole number of an alkoxy group of the alkoxide and stirred, whereby the transparent partially hydrolyzed sol is obtained.

The partially hydrolyzed sol of the present invention has a viscosity of not much more than 1 to 10 cp at a concentration of about 40 weight %. It remains in a condition that it is easy to be sprayed in coating, and a thickener may be added or it may be diluted according to necessity.

The partially hydrolyzed sol of the present invention may be used in an amount of from 0.01 to 20 weight %, preferably 0.1 to 5 weight % based on a carrier core in terms of a sol.

It is effective for controlling the charging property of a carrier to add an alkoxide of at least one element selected from the group consisting of B, Mg, Al, Si, Ca, Ti, V, Cr, Mn, Fe, Co, Ni, Cu, Zn, Ca, Ge, Sr, Y, Zr, Nb, In, Sn, Sb, Ba, La, Ce, Pt, Nd, Sm, Gd, Dy, Er, Yb, and Ta to form a coated layer. An addition amount is preferably 50 weight % or less based on the partially hydrolyzed sol.

All of what have so far been publicly known can be used as the core particle (for a carrier) used in the present invention, and in order to obtain a developer of a long life, iron oxide and ferrite and magnetite each having a light specific gravity are preferred.

The carrier of the present invention is prepared by coating the partially hydrolyzed sol on the whole surface of the core particle by, for example, a dipping process, a spraying process or a fluidized bed process and then drying and curing. With respect to a curing condition, a hardness equal to that of a conventional resin-coated layer can sufficiently be obtained even at an ordinary temperature. However, in order to obtain the carrier having a very excellent stability which is aimed in the present invention, heating at the conditions described above is preferred. Curing is carried out preferably at 150° C. or higher in about 20 to 30 minutes. The upper limit of the temperature is not specifically limited so long as it is not a temperature which can melt the carrier.

All conventional toners can be used in combination with the carrier of the present invention. In addition to the conventional toners produced by blending and pulverizing methods, the toners produced by spray dry methods and polymerization methods can be used as well. Further, the carrier of the present invention can conveniently be used also as a carrier for color toners. Further, it can be applied either to a positively chargeable toner or a negatively chargeable toner according to selection of various alkoxides to be added.

The partially hydrolyzed sol used in the present invention, obtained from at least one alkoxide selected from the group consisting of silicon alkoxides, titanium alkoxides, aluminum alkoxides and zirconium alkoxides forms a very hard coated film on a surface of a carrier core particle. That makes it possible to always supply a stable image without a coated layer being peeled off during use by using the carrier of the present invention mixed with a toner to prepare a developer. Further, the charging property of the carrier can arbitrarily be controlled by adding alkoxide of at least one element selected from the group consisting of B, Mg, Al, Si, Ca, Ti, V, Cr, Mn, Fe, Co, Ni, Cu, Zn, Ca, Ge, Sr, Y, Zr, Nb, In, Sn, Sb, Ba, La, Ce, Pt, Nd, Sm, Gd, Dy, Er, Yb, and Ta to form a coated layer, and the present carrier can be applied to various developers.

EXAMPLES

The examples of the present invention and the comparative examples will be described below but the present invention will not be limited to these examples. Parts means parts by weight unless otherwise described.

Example 1

The partially hydrolyzed sol 2 parts (viscosity at 25° C. in terms of a solid content of 40%: 8 cp) obtained by partially hydrolyzing tetramethoxysilane, NIC-C5 manufactured by Shinagawa Shirorenga Co., Ltd., was evenly coated on a ferrite core 100 parts, FL-100 manufactured by Powdertech Co., Ltd. on a fluidized bed using a mixed solution of xylene and butyl acetate as a solvent. Then, it was left for standing for 20 minutes in an oven kept at 170° C. to cure a coated film. Rough powder was removed from this carrier with a sieve of 100 mesh and fine powder with a sieve of 200 mesh to thereby obtain Carrier 1 of the present invention.

Example 2

The partially hydrolyzed sol (viscosity at 25° C. in terms of a solid content of 40%: 8 cp) 1.9 part obtained by partially hydrolyzing tetramethoxysilane, NIC-C5 manufactured by Shinagawa Shirorenga Co., Ltd., and yttrium ethoxide 0.1 part, AMILATE-LR-Y manufactured by Hakusui Chemical Industries Ltd. were evenly coated on the ferrite core 100 parts, FL-100 manufactured by Powdertech Co., Ltd. on the fluidized bed using the mixed solution of xylene and butyl acetate as the solvent. Then, it was left for standing for 20 minutes in the oven kept at 170° C. to cure a coated film. Rough powder was removed from this carrier with the sieve of 100 mesh and fine powder with the sieve of 200 mesh to thereby obtain Carrier 2 of the present invention.

Comparative Example 1

A methyl dimethyl silicone resin 2 parts was evenly coated on the ferrite core 100 parts, FL-100 manufactured by Powdertech Co., Ltd. on the fluidized bed. Then, it was left for standing for 3 hours in the oven kept at 190° C. to cure a coated film with methyl tetramethoxysilane used as a crosslinking agent. Rough powder was removed from this carrier with the sieve of 100 mesh and fine powder with the sieve of 200 mesh to thereby obtain Carrier 3 of the present invention.

| Evaluation test | |
|---|---|
| Polyester resin (softening point: 133° C., glass transition point: 62° C.) prepared from the ingredient monomers of terephthalic acid, n-dodecenyl succinate, trimellitic acid, an ethylene oxide adduct of bisphenol A, and a propylene oxide adduct of bisphenol A | 100 parts |
| Carbon black | 6 parts |
| Azo-complex of iron, T-77 manufactured by Hodogaya Chemical Co., Ltd. | 3 parts |
| Polypropylene wax | 2 parts |

were preliminarily mixed, melt-blended, pulverized with a Jet Mill (tradename) and then classified in size to thereby obtain a colored particle having an average particle size of 8.2 mm. This colored particle 100 parts was mixed with 0.4 part of Aerosil R-972, manufactured by Nippon Aerosil Co., Ltd. using a Henshel mixer, manufactured by Mitsui Miike Engineering Co., Ltd. to obtain Toner A.

3377.5 g of Carriers 1 to 3 were mixed with 122.5 of Toner A, respectively, in V Blender, manufactured by Ikemoto Rika Industry Co., Ltd. to obtain a developer.

This developer was introduced into a developing unit of a copying machine, SD-2075 manufactured by Sharp Corporation, and an idling operation was carried out for 30 hours. A residual rate of a coated layer before and after the idling operation was measured by X-ray fluorescence analysis of a content of a silicon element. Very good results of a residual rate of 96% for Carrier 1 of the present invention and a residual rate of 93% for Carrier 2 of the present invention based on a silicon amount of 100% in the coated layer before the idling operation were obtained. Carrier 3 of the comparative example, however, had the residual rate of 65%, and peeling of the coated layer was obviously observed.

Further, a usual copying test was carried out with the developers obtained after the idling operation. While the developers of Carriers 1 and 2 of the present invention had no problems on both image density and fog, increase in the fog was apparently observed in the developer of Carrier 3. The image density was measured with a Macbeth densitometer, and the fog was determined by measuring a difference in a whiteness of a paper before and after passing the paper with a color and color difference meter manufactured by Nippon Denshoku Co., Ltd.

Further, the developer obtained after the idling operation was used to carry out a usual copying test. According to the results thereof, while the developers prepared with Carriers 1 and 2 of the present invention had no problems on either image density or fog, apparent increase in the fog was observed in the developer of Carrier 3. The image density was measured with a Macbeth densitometer, and the fog was determined by measuring a difference in a whiteness of a paper with a colorimetric color difference meter manufactured by Nippon Denshoku Co., Ltd. before and after passing the paper. The results are shown in the following Table 1.

TABLE 1

| | Initial | | After idling | |
|---|---|---|---|---|
| | Image density | Fog | Image density | Fog |
| Carrier 1 | 1.40 | 0.45 | 1.42 | 0.49 |
| Carrier 2 | 1.41 | 0.38 | 1.41 | 0.43 |
| Carrier 3 | 1.41 | 0.40 | 1.46 | 1.87 |

What is claimed is:

1. A developer composition which comprises a toner and an electrophotographic carrier core particle comprising an electrophotographic particle and a coated layer on the surface thereof, said coated layer obtained by curing a partially hydrolyzed sol obtained from at least one alkoxide selected from the group consisting of silicon alkoxides, titanium alkoxides, aluminum alkoxides and zirconium alkoxides.

2. The developer composition as claimed in claim 1, wherein the coated layer of the electrophotographic carrier particle further comprises an alkoxide containing at least one element selected form the group consisting of B, Mg, Al, Si, Ca, Ti, V, Cr, Mn, Fe, Co, Ni, Cu, Zn, Ga, Ge, Sr, Y, Zr, Nb, In, Sn, Sb, Ba, La, Ce, Pr, Nd, Sm, Gd, Dy, Er, Yb, and Ta.

3. In a method for developing an electrostatic latent image with a developer, the improvement comprising using the developer composition as defined in claim 1.

4. The developer as claimed in claim 1, in which the coated layer of the coated electrophotographic carrier particle consists essentially of the partially hydrolyzed sol.

5. The developer as claimed in claim 1, wherein the coated electrophotographic carrier particle consists essentially of the core particle and the coated layer.

6. A developer composition comprising a toner and a coated electrophotographic carrier particle which consists essentially of:

an electrophotographic core particle and a crosslinked alkoxide coated on said core particle, said alkoxide selected from the group consisting of silicon alkoxides, titanium alkoxides, aluminum alkoxides and zirconium alkoxides.

7. The developer as claimed in claim 1, in which said alkoxide is a silicon alkoxide.

* * * * *